US010872501B1

(12) United States Patent
Georgilas et al.

(10) Patent No.: US 10,872,501 B1
(45) Date of Patent: Dec. 22, 2020

(54) GAMING DEVICE AND SYSTEM INCLUDING A TIMED, SKILLED-BASED BONUS GAME AND METHOD OF USING THE SAME

(71) Applicant: First Gaming Group, LLC, Las Vegas, NV (US)

(72) Inventors: Justin Tilemahos Georgilas, Las Vegas, NV (US); Evgeny Bronnikov, Novosibirsk (RU)

(73) Assignee: First Gaming Group, LLC, Las Vegas, NV (US)

( * ) Notice: Subject to any disclaimer, the term of this patent is extended or adjusted under 35 U.S.C. 154(b) by 0 days.

(21) Appl. No.: 15/649,534

(22) Filed: Jul. 13, 2017

Related U.S. Application Data

(60) Provisional application No. 62/361,668, filed on Jul. 13, 2016.

(51) Int. Cl.
*G07F 17/32* (2006.01)
*G07F 17/34* (2006.01)

(52) U.S. Cl.
CPC ..... *G07F 17/3267* (2013.01); *G07F 17/3209* (2013.01); *G07F 17/3213* (2013.01); *G07F 17/3225* (2013.01); *G07F 17/34* (2013.01)

(58) Field of Classification Search
CPC ..... G07F 17/3267; G07F 17/3209
See application file for complete search history.

(56) References Cited

U.S. PATENT DOCUMENTS

2002/0039923 A1* 4/2002 Cannon ..... G07F 17/32 463/42
2009/0042641 A1* 2/2009 Anderson ..... G07F 17/32 463/25
2010/0029381 A1* 2/2010 Vancura ..... G07F 17/3244 463/30
2012/0094739 A1* 4/2012 Louie ..... G07F 17/34 463/20

* cited by examiner

*Primary Examiner* — William H McCulloch, Jr.
*Assistant Examiner* — Ankit B Doshi
(74) *Attorney, Agent, or Firm* — FisherBroyles, LLP; Rob L. Phillips

(57) ABSTRACT

A gaming system including multiple gaming devices (e.g., slot machines) forming a network. The network includes a common bonus game, which when activated, is played by all players on the network. The bonus game may be skill based and played in accordance with time credits earned during play of a primary game. The multiple gaming devices may comprise linked standalone gaming devices, mobile gaming devices (e.g., smart devices), server-based gaming devices, etc. Individual gaming devices may also benefit from the timed, skill-based bonus game.

4 Claims, 7 Drawing Sheets

355

350

GAMING DEVICE AND SYSTEM INCLUDING A TIMED, SKILLED-BASED BONUS GAME AND METHOD OF USING THE SAME

CROSS-REFERENCE

This application claims priority to U.S. Patent Application No. 62/361,668 filed Jul. 13, 2016 which is incorporated herein for all purposes.

FIELD OF THE INVENTION

The embodiments of the present invention relate to a gaming device and system including multiple gaming devices forming a network for facilitating a primary game during which players collect time useable to play a skill-based bonus game.

BACKGROUND

Gaming continues to grow throughout the United States. The primary area of growth in recent years relates to slot machines and related electronic casino games, including skill-based games. Skill-based games have been approved by numerous states, including Nevada.

Moreover, conventional slot machines and other electronic gaming devices can become stale after being on the casino floor for long periods of time. Younger gamblers (e.g., between 21 years old and 30 years old) are not as interested in playing gaming devices having random outcomes. Skill-based games are attractive to younger gamblers (i.e., Millennials) that have been raised with very advanced and exciting skill-based video games.

Thus, it would be advantageous to develop new, exciting gaming devices with skill-based features to attract younger gamblers and re-invigorate mature gamblers.

SUMMARY

The embodiments of the present invention are directed to a gaming device and system including multiple gaming devices (e.g., slot machines) forming a network. The network includes a common bonus game, which when activated, is played by all players playing a gaming device on the network. In one embodiment, the bonus game is skill based and played in accordance with time credits earned during play of a primary game. The bonus game may also be controlled, in part, by a random number generator (RNG).

One embodiment comprises a gaming system including multiple gaming devices forming a gaming device network, each gaming device having at least a display, user interface and memory, each gaming device in communication with one or more processors; and wherein said one or more processors run executable instructions to: (i) generate random primary game outcomes; (ii) store collected time for each of said multiple gaming devices on said network, said collected time associated with pre-established primary game outcomes; (iii) advance one or more players to a skill-based bonus game based on a primary game trigger condition being met; and (iv) permit play of said skill-based bonus game for an amount of time based on said stored collected time for each active gaming device The multiple gaming devices may comprise linked standalone gaming devices, mobile gaming devices (e.g., smart devices), server-based gaming devices, etc.

Other variations, embodiments and features of the present invention will become evident from the following detailed description, drawings and claims.

DETAILED DESCRIPTION

Figure 1:
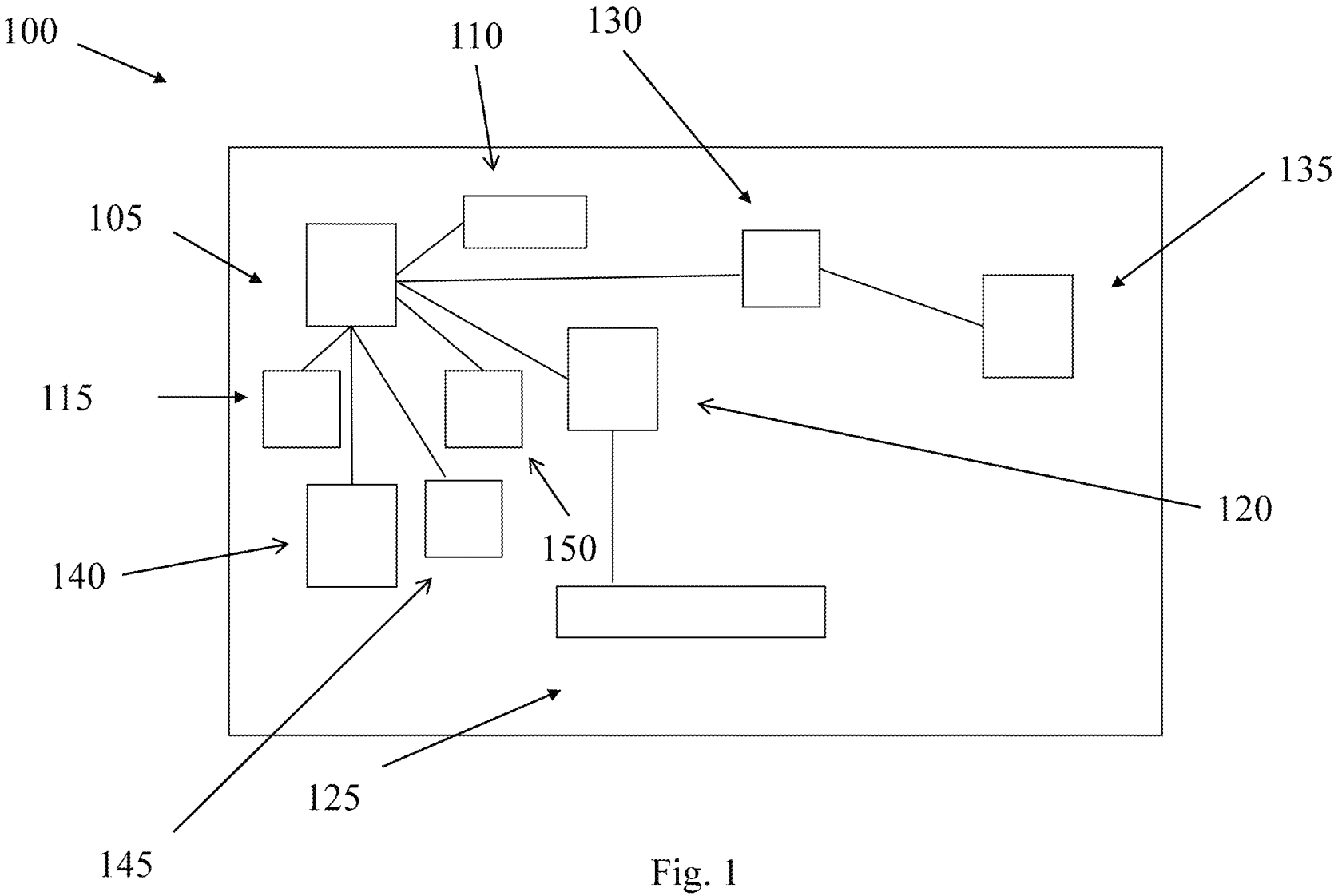
FIG. 1 illustrates a block diagram of components of an electronic gaming device for conducting a game according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the embodiments of the present invention involve both hardware and software elements which portions are described below in such detail required to construct and operate a game method and system according to the embodiments of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams. As used herein, a "gaming device" should be understood to be any one of a general purpose computer, as for example a personal computer or a laptop computer, a client computer configured for interaction with a server, a special purpose computer such as a server, or a smart phone, soft phone, tablet computer, personal digital assistant or any other machine adapted for executing programmable instructions in accordance with the description thereof set forth above.

The embodiments of the present invention may be facilitated by an electronic gaming device whereby a single player plays against the electronic gaming device's processor as described herein. The electronic gaming device may be a standalone device and bar-top device forming part of a gaming device network or not. A block diagram of the electronic gaming device 100 is shown in FIG. 1. The exemplary electronic gaming device 100 may include a central processing unit (CPU) also deemed a processor 105 which controls the electronic gaming device 100 based on instructions stored in program read-only memory (ROM) 110 and pay table ROM 115. Program ROM 110 stores executable instructions related to the operation of the gaming device 100 and which are generally permanent. CPU 105 may be connected to a video controller 120 which provides output to one or more video displays 125. Similarly, an audio controller 130 provides audio output as dictated by the CPU 105 through speakers 135. The aforementioned components, and others, may be attached to a circuit board forming a motherboard. In another embodiment, the electronic gaming device 100 may be linked to a central game server which allows players to select from a number of games via the electronic gaming device 100. In such an embodiment, one or more processors integrated into the central server control the gaming device 100 based on instructions stored in program ROM 110.

A user interface 140 may respond to buttons on button panel or display incorporating touch screen technology or any other devices providing means for users to communicate with, and instruct, the electronic gaming device 100. Wager memory 145 stores an amount of money/credits deposited into the electronic gaming device 100 by a player and specific wager information related to each play of the electronic gaming device 100. Payout system 150 includes a coupon printer or similar device for receiving money/coupon from the electronic gaming device 100.

Those skilled in the art will recognize that the configuration and features of the electronic gaming device 100 disclosed herein are exemplary and may be altered in any number of ways without impacting the embodiments of the present invention.

Figure 2:
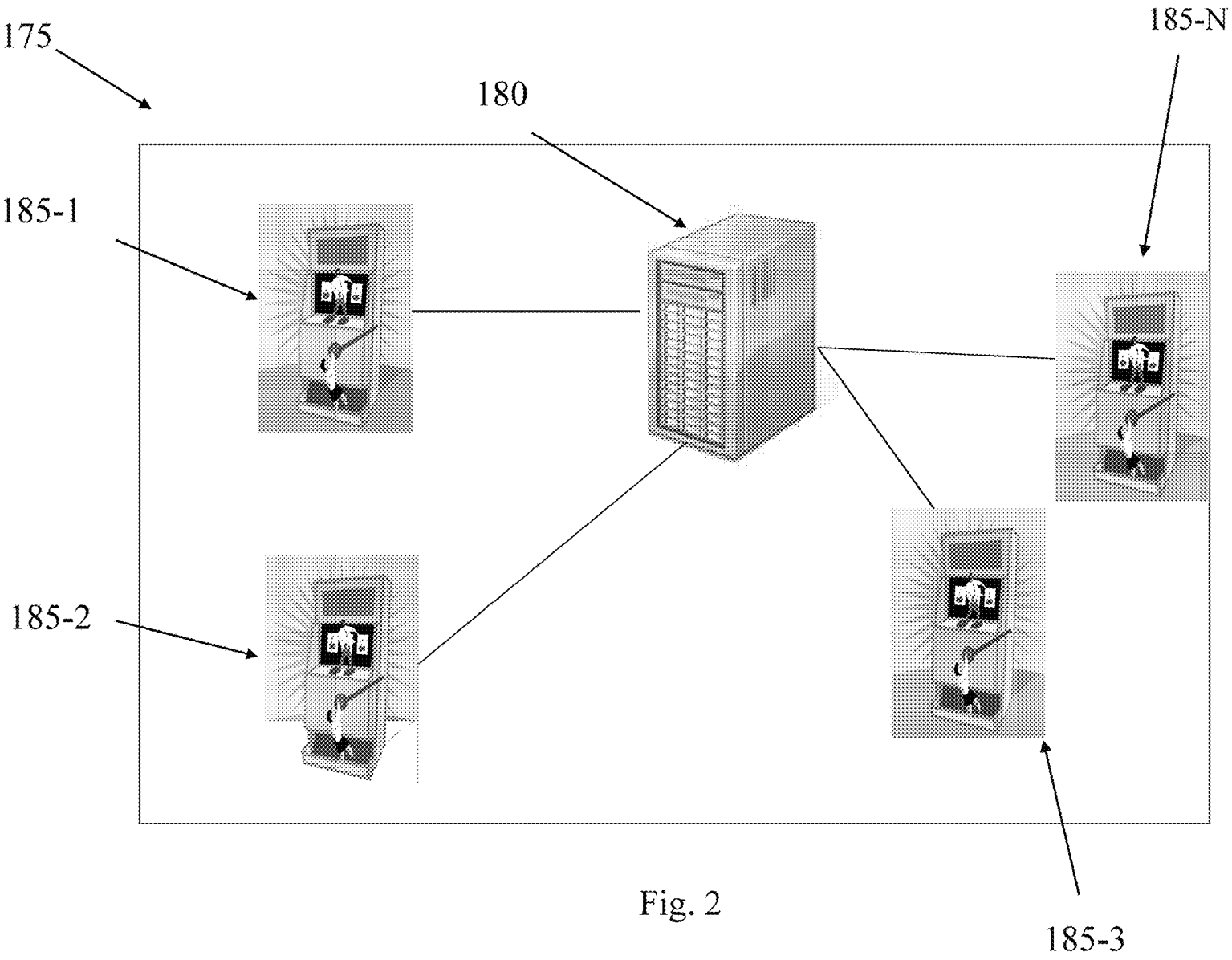
FIG. 2 illustrates a block diagram of a gaming network including numerous slot machines according to the embodiments of the present invention.

FIG. 2 shows a block diagram of a gaming network 175 which may be used to facilitate play of the game via linked gaming devices according to the embodiments of the present invention. The gaming network 175 comprises a central processor 180 (e.g., processor-equipped game server) in communication with multiple gaming devices 185-1 through 185-N as described in FIG. 1.

Figure 3:
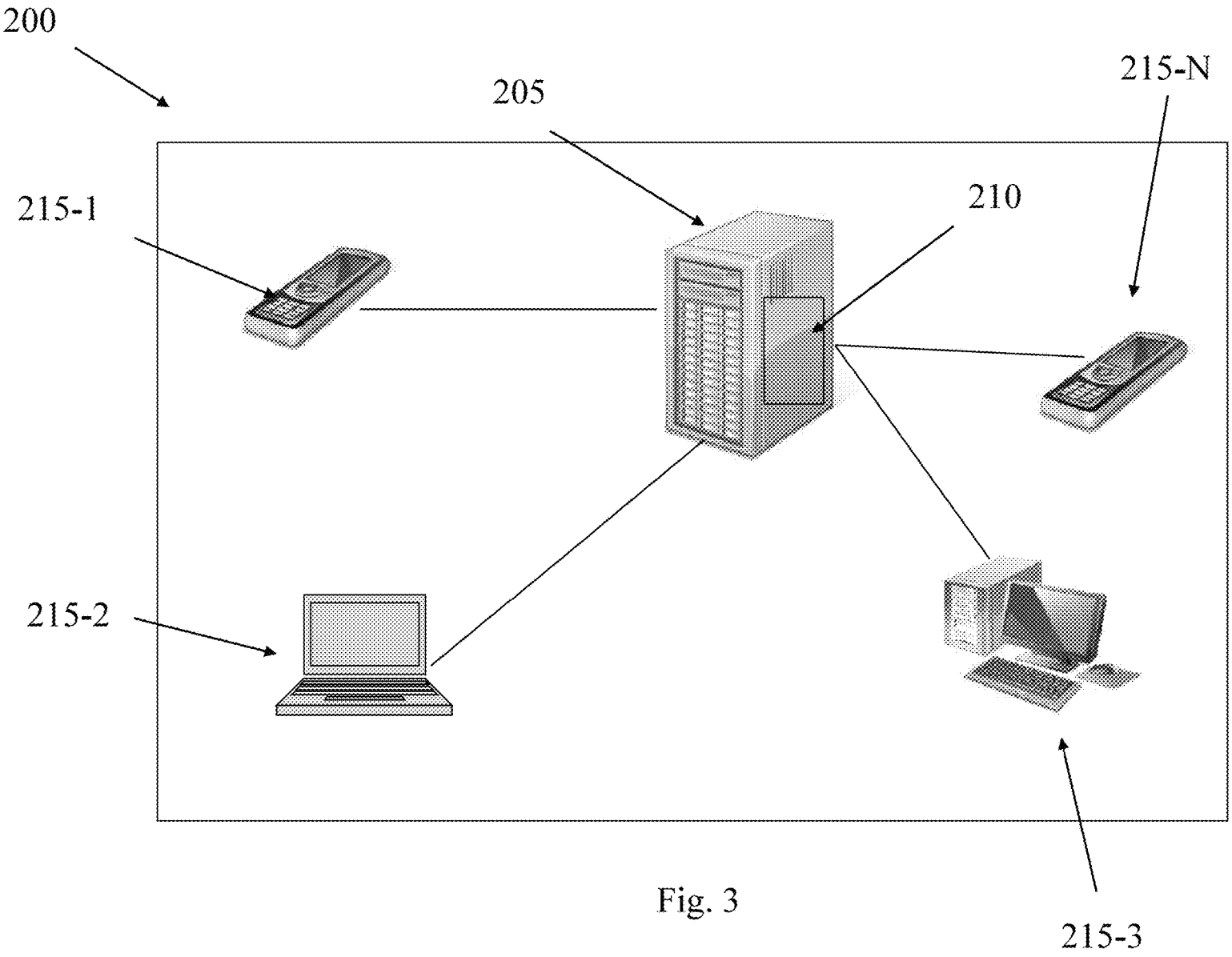
FIG. 3 illustrates a block diagram of a wireless network system accessible by mobile devices for conducting mobile games of chance according to the embodiments of the present invention.

FIG. 3 shows a block diagram of a wireless system 200 which may be used to facilitate remote play of the game according to the embodiments of the present invention. The wireless network system 200 comprises a processor-equipped game server 205, including one or more processors 210 running game software, and remote devices 215-1 through 215-N (e.g., smart phones) configured to access said game server 205 facilitating game play on the remote devices 215-1 through 215-N. In another embodiment, the video game according to the embodiments of the present invention may be in the form of a software application ("App") downloadable onto smart phones, tablets or computers and playable via processing power and a user interface associated therewith.

Figure 4:
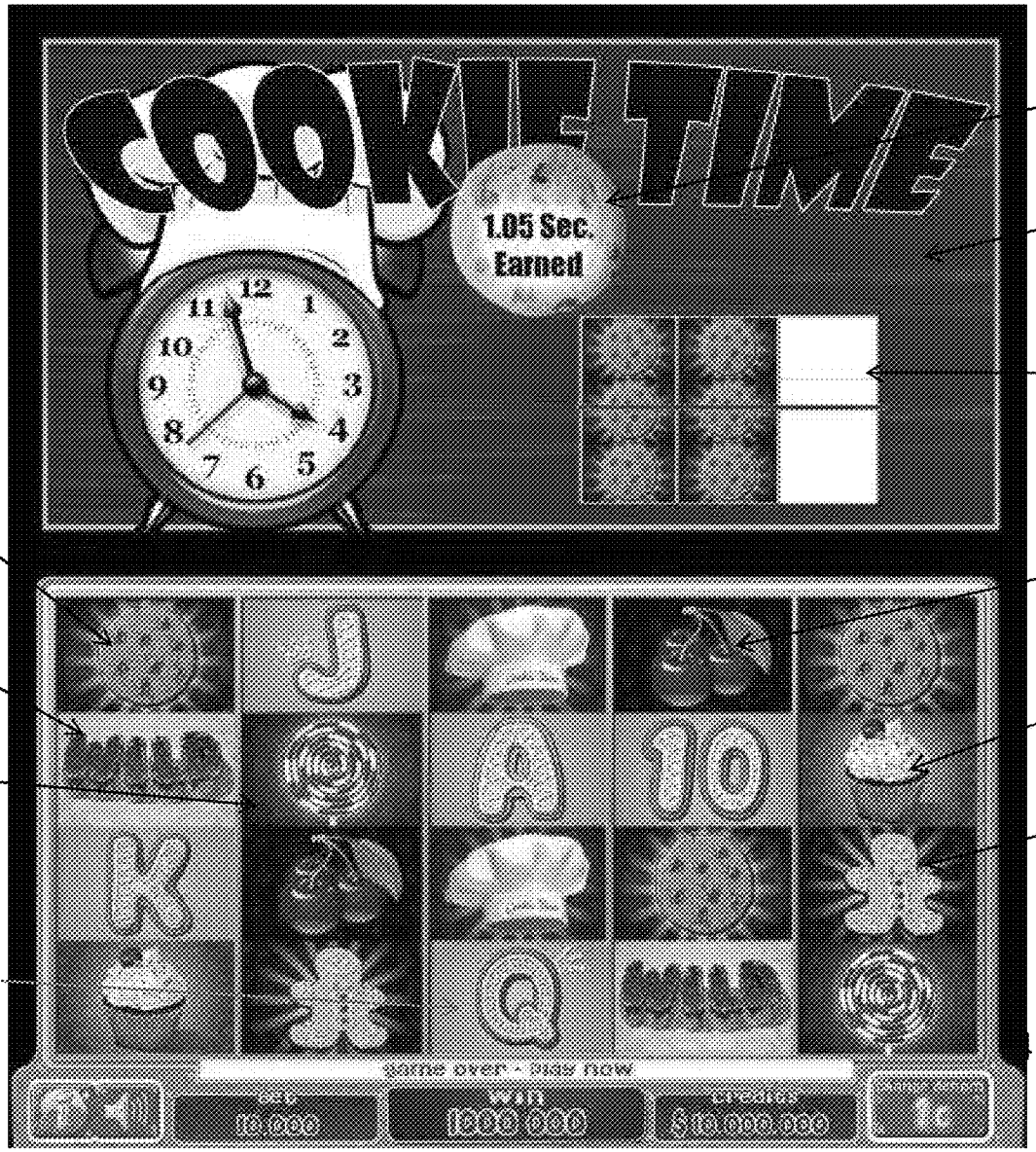
FIG. 4 illustrates a game screen depicting a primary game according to the embodiments of the present invention.

FIG. 4 shows a screen shot 300 of a video-based slot game according to the embodiments of the present invention. As shown, the primary video-based slot game comprises five video reels 305-1 through 305-5 each depicting game symbols 310 including cookie game symbols 315. Positioned above the primary video-based slot game is bonus game 320. While the video-based slot game and bonus game 320 may take on any theme or brand, the depicted theme is "Cookie Time." Moreover, the primary video-based slot game may be any electronic game of chance including video poker, keno, bingo, blackjack, roulette, etc. The general operation of a slot machine is well known in the art and need not be disclosed herein. This disclosure will focus on the inventive features of the improved gaming device, gaming network and method according to the embodiments of the present invention.

The bonus game 320 includes a bonus timer 325 and cookie counter 330. The timer 325 tracks an amount of time collected by the player playing the primary game on the corresponding gaming device. As shown, time is collected when cookie game symbols 315 align along a winning primary game pay line. Those skilled in the art will recognize that time may be collected based on any desirable pre-established primary game outcomes. In one embodiment, once the bonus game is triggered responsive to one or more pre-established primary game outcomes on one or more gaming devices forming the network, all players playing a device forming the network advance to the bonus game. In one embodiment, the bonus game includes a progressive award and/or skill-based component.

Figure 5:
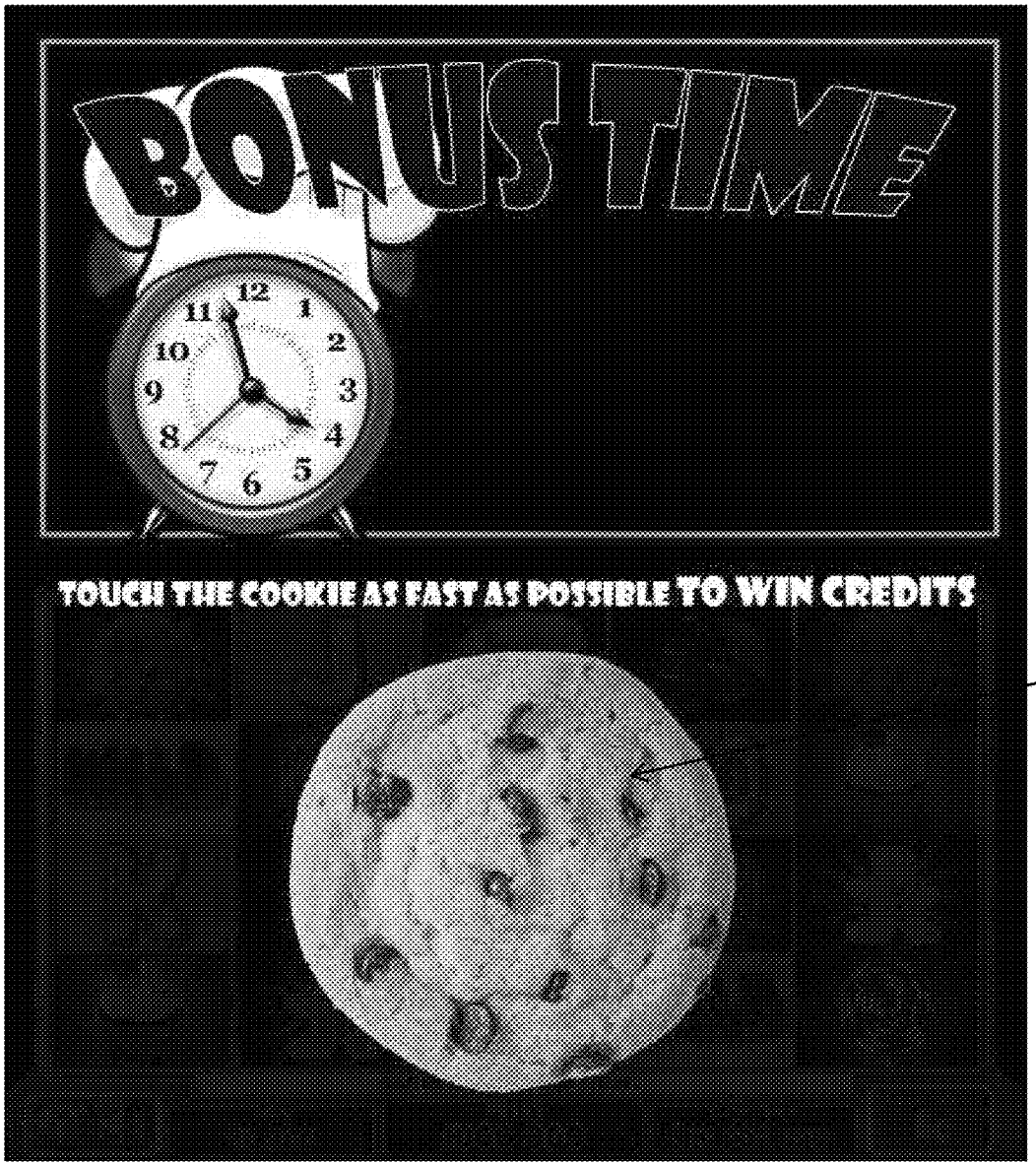
FIG. 5 illustrates a game screen depicting a skill-based bonus game according to the embodiments of the present invention.

FIG. 5 shows a skilled-based bonus game 350 including a bonus cookie symbol 355 depicted on the primary video-based screen. In one embodiment, when players advance to the bonus game, the primary game screen is adapted for playing the bonus game. In this embodiment, players are prompted to tap or touch the bonus cookie symbol 355 as many times as possible during the available time collected during play of the primary game. Accordingly, the skill component is premised on each player's quickness and dexterity. In one embodiment, each player continues the skilled exercise based on the time each player has collected. Alternatively, all collected time across the network is aggregated into a network pool such that each player has the same amount of time to continue the skilled exercise during the bonus game. Alternatively, all players have time equivalent to the maximum player time collected. In any case, a bonus award is premised on the number of times each player taps the cookie game symbol 355 on this screen during the collected time. Again, the bonus awards may be based on each player's number of touches or an aggregate number of touches across all players on the network. Those skilled in the art will recognize that other skill-based games may facilitate the bonus game. For example, aim and shoot games, trivia games, collect icon games, etc., may facilitate the bonus game.

Figure 6:
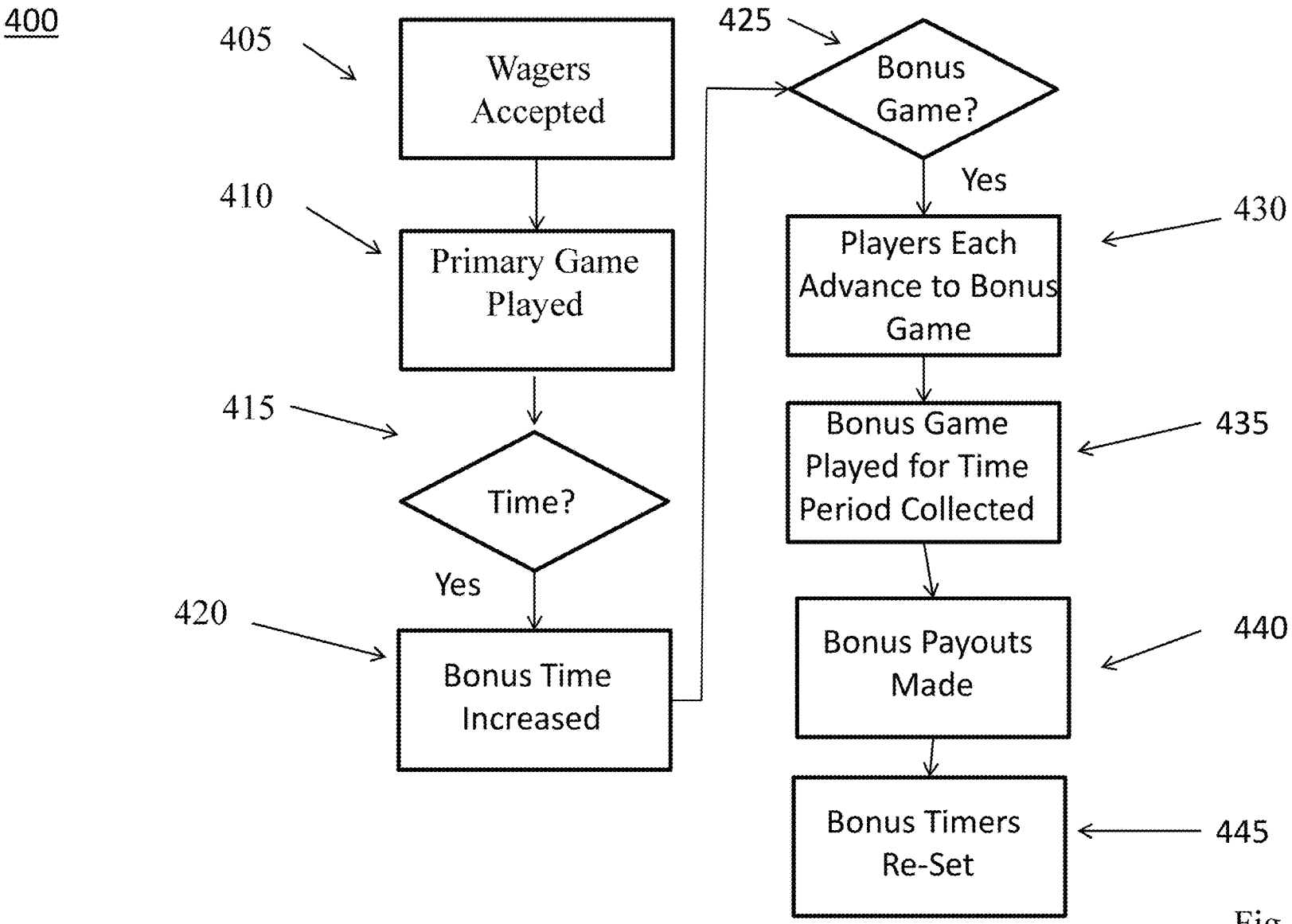
FIG. 6 illustrates a flow chart detailing one methodology for conducting a game according to the embodiments of the present invention.

FIG. 6 shows a flow chart 400 detailing one methodology for conducting a game according to the embodiments of the present invention. At 405, the gaming devices receive wagers from players on the gaming devices forming the network. At 410, players activate the primary game. At 415, it is determined if the primary game outcome includes the collection of time. If so, at 420, a bonus timer is increased by the amount of the collection of time (e.g., 3 seconds). At 425, it is determined if the primary game outcome is a bonus game trigger (e.g., pre-established alignment of game symbols along an active pay line). If so, at 430, all players on the network advance to the bonus game. At 435, all players play the skill-based bonus game for an amount of time commensurate with the collected time which may comprise (i) each player's individual collected time, (ii) the aggregate time collected across the network or (iii) the time associated with the player having collected the most time. In one embodiment, the bonus game includes a progressive award based on a player or players collectively reaching a pre-established number of touches during the collected bonus time. In one embodiment, the progressive jackpot amount is displayed on the bonus screen of each of the gaming devices forming the gaming device network or a remote display proximate to the gaming device network when in a casino. At 440, bonus awards are paid to players based on the number of touches of the cookie game symbol during the collected time. At 445, bonus timers are re-set to zero or some other initial base time.

Figure 7:
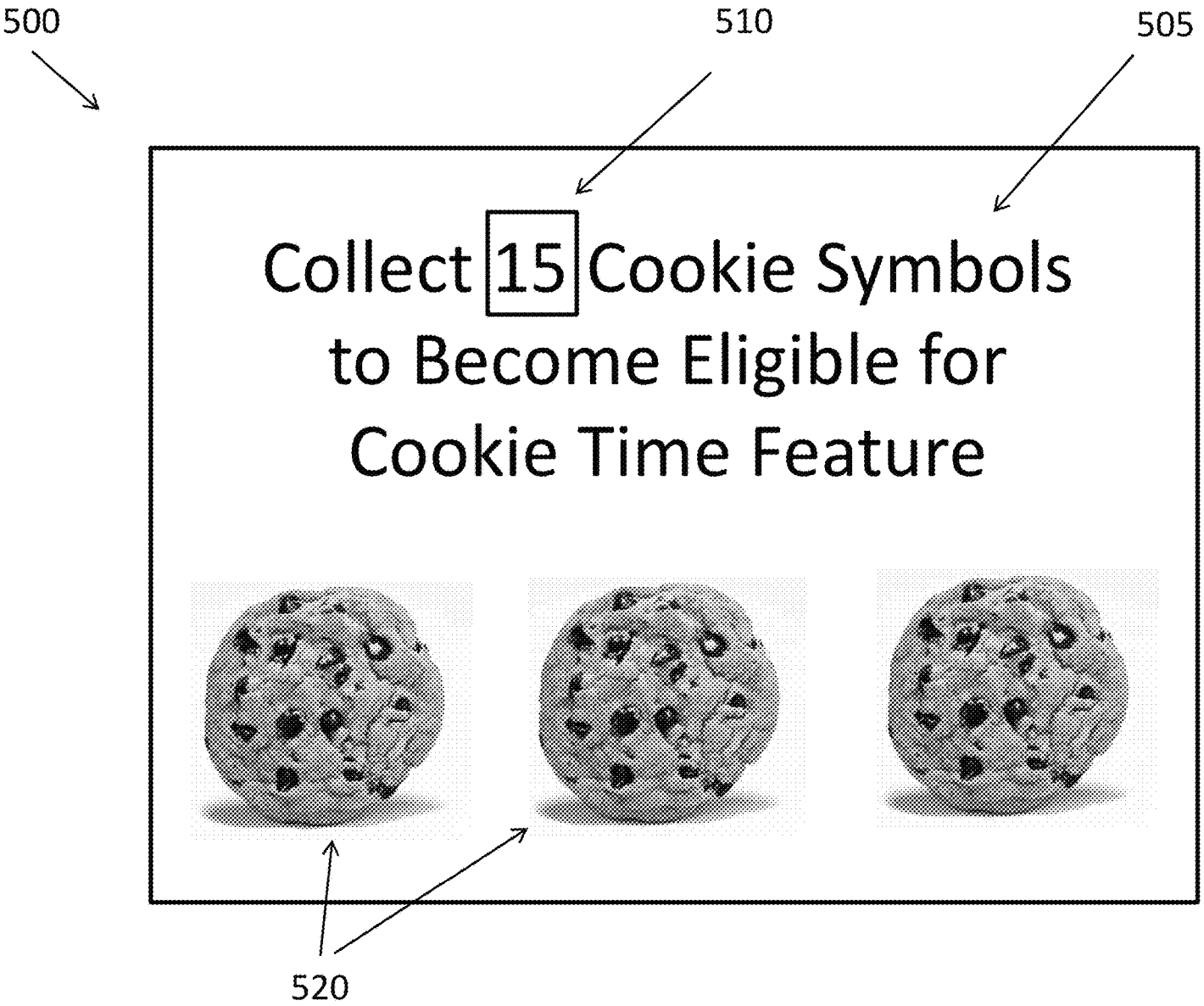
FIG. 7 illustrates a second embodiment of the skill-based bonus game according to the embodiments of the present invention.

FIG. 7 shows a second embodiment of the skill-based bonus game 500 according to the embodiments of the present invention. In this embodiment, players collect cookie icons during the primary game. The bonus game screen 505 depicts "Collect 15 Cookie Symbols to Become Eligible for Cookie Time Feature." The number of cookie symbols 510 is dynamic and decreases until reaching zero at which time the bonus game screen shall depict "Player Eligible for Cookie Time Feature." Cookies may also be depicted representing a real-time number of cookies 515 collected thus far. At this stage, all players on the network play the bonus game for a collected period of time or fixed amount time.

In one embodiment, when a player concludes a gaming session at a gaming device having stored collected time, game symbols or other data, the system causes the stored information to re-set to zero after the passage of a period of time without play, the player removes a player card from the gaming device or the player cashes out. Alternatively, the stored information may remain stored for the benefit of the next player.

In another embodiment, advancing to the bonus game is predicated on one or more pre-established primary game outcomes occurring on at least one of the gaming devices on the network (e.g., pre-established group of symbols appearing on game screen). All active gaming devices on the network are then advanced to the skill-based bonus game. An active gaming device is one having been played within a pre-defined period of time (e.g., three seconds) of the occurrence of said one or more pre-established primary game outcomes.

Those skilled in the art will recognize that the embodiments of the present invention may relate to individual gaming devices (networked or not) whereby a player may play a primary game and responsive to the collection of time, collection of game symbols or random primary game outcome advance to a timed and skill-based bonus game which the player plays.

Those skilled in the art will understand that there are countless trigger conditions that may advance a player or players to the timed, skilled-based bonus game. Such trigger conditions include one or more primary game outcomes, the collection of a pre-established number of game symbols or time, a random determination, a passage of time, etc. In a network embodiment, the trigger conditions may be related to any single gaming device achieving the trigger condition or each of the gaming devices achieving the trigger condition (e.g., each active gaming device must collect 10 gaming symbols before all advance to the timed, skilled-based bonus game).

Although the invention has been described in detail with reference to several embodiments, additional variations and modifications exist within the scope and spirit of the invention as described and defined in the following claims.

We claim:

1. A gaming system comprising:

multiple gaming devices forming a gaming device network, each gaming device having at least a display, user interface and memory, each gaming device in communication with one or more processors; and wherein said one or more processors run executable instructions to: (i) generate random primary game outcomes; (ii) store collected time for each of said multiple gaming devices on said network, said collected time generated responsive to pre-established primary game outcomes; (iii) advance each player on said gaming device network to a skill-based bonus game based on a primary game trigger condition being met at any one of said multiple gaming devices forming said gaming device network; (iv) permit play of said skill-based bonus game by each player on said gaming device network for an amount of time equal to a sum of all said collected time stored for each active gaming device such that each player is permitted to play said skill-based bonus game for the sum of all collected time across all active gaming devices; and (v) award a progressive jackpot responsive to a collective skill-based result above a progressive threshold obtained by all players participating in said skill-based bonus game.

2. The gaming device system of claim 1 wherein said trigger condition includes one or more primary game outcomes, the collection of a pre-established number of game symbols or time, a random determination and/or a passage of time.

3. A method comprising:

utilizing a plurality of gaming devices to facilitate play of a gambling game, each of said plurality of gaming devices having at least a display, user interface and memory, each of said plurality of gaming devices in communication with one or more processors; and configuring said one or more processors for:

generating primary game outcomes for each of said plurality of gaming devices;

storing in memory of said plurality of gaming devices collected time associated with each of said plurality of gaming devices, said collected time generated responsive to pre-established primary game outcomes;

advancing all players on said plurality of gaming devices to a skill-based bonus game based on a primary game trigger condition being met on one of said plurality of gaming devices;

permitting play of said skill-based bonus game by said all players on said plurality of gaming devices for an amount of time equal to a sum of all said collected time stored for each active gaming device such that each player is permitted to play said skill-based bonus game for the sum of all collected time across all active gaming devices; and awarding a progressive jackpot responsive to a collective skill-based result above a progressive threshold obtained by all players participating in said skill-based bonus game.

4. The method of claim 3 further comprising configuring said one or more processors for establishing said trigger condition to include one or more primary game outcomes, the collection of a pre-established number of game symbols or time, a random determination and/or a passage of time.

* * * * *